US006415576B1

(12) United States Patent
Stromback

(10) Patent No.: US 6,415,576 B1
(45) Date of Patent: Jul. 9, 2002

(54) REINFORCING RIDGE APPARATUS AND METHOD

(76) Inventor: Gustav M. Stromback, 9019 Balcones Club Dr., Austin, TX (US) 78750

( * ) Notice: Subject to any disclaimer, the term of this patent is extended or adjusted under 35 U.S.C. 154(b) by 0 days.

(21) Appl. No.: 09/669,313

(22) Filed: Sep. 25, 2000

(51) Int. Cl.[7] ..... E04C 5/16

(52) U.S. Cl. ..... 52/719; 52/731.9; 52/730.4; 52/730.1; 428/35.8

(58) Field of Search ..... 52/720.1, 719, 52/588.1, 592.4, 648.1, 650.1, 655.1, 653.2, 730.5, 731.3, 732.2

(56) References Cited

U.S. PATENT DOCUMENTS 5,483,782 A * 1/1996 Hall ..... 52/730.1
5,514,432 A * 5/1996 Lisec ..... 428/35.8
5,791,115 A * 8/1998 Nicolai et al. ..... 52/730.4
5,860,265 A * 1/1999 Knudson et al. ..... 52/731.9

* cited by examiner

*Primary Examiner*—Carl D. Friedman
*Assistant Examiner*—Steve M. Varner
(74) *Attorney, Agent, or Firm*—J. Nevin Shaffer, Jr.; Shaffer & Culbertson, LLP

(57) ABSTRACT

In a length of rigid material (12) with first and second unjoined edges (16 and 20), a reinforcing ridge (10) includes a short extension (14) connected to the first unjoined edge (16). A long extension (18) is connected to the second unjoined edge (20). When the unjoined edges (16 and 20) are brought together, the long extension (18) is bent over the short extension (14) forming a connection locking slot (22) and the reinforcing ridge (10). In a preferred embodiment, at least one reinforcing rib (26) is formed in a side opposite the reinforcing ridge (10) and at least one strength indent (28) is formed in a side adjacent to the reinforcing ridge (10). As formed, the rigid material is sufficiently strong to resist collapse when joined together by use of automatic joining devices.

18 Claims, 2 Drawing Sheets

REINFORCING RIDGE APPARATUS AND METHOD

BACKGROUND OF THE INVENTION

This invention relates to an improved reinforcing ridge for structural construction materials. In particular, this invention relates to a reinforcing ridge formed in a length of rigid material with first and second unjoined edges.

The difficulties of building structures out of man-made materials are many. A major difficulty is making the material rigid enough to resist compression, torsion and bending. In the field of metal housing, for example, lengths of sheet metal are formed into rectangular beams of various lengths and subsequently joined together. The prior art metal beams, when formed into rectangular shapes, dealt with the unjoined edges in one of two ways. Sometimes the unjoined edges were left unjoined so that open space existed. This is an inexpensive way to form a metal beam. Unfortunately, beams formed in this manner are not structurally strong in that they are easily deformed. The second way that the prior art handles the unjoined edges is to screw or weld them together. This results in a much more structurally sound man-made beam but dramatically increases the cost.

Additionally, either of the prior art solutions to the problem of the unjoined edges results in a man-made beam that is difficult and time-consuming, and therefore costly, to join with other beams. Currently, man-made materials such as these are joined together by screws and bolts individually attached in a labor-intensive manner. Thus, there is a need in the art for providing a reinforcing ridge in rigid material that not only deals with the problem of satisfactorily joining the unjoined edges but also results in a man-made structure that supports the use of automatic joining devices, such as pneumatic guns and screws. It, therefore, is an object of this invention to provide an improved reinforcing ridge system in man-made materials, such as metal tubing, that simply and inexpensively joins the unjoined edges without the use of screws and simultaneously results in a structure that supports the use of automatic joining devices.

SHORT STATEMENT OF THE INVENTION

Accordingly, in a length of rigid material with first and second unjoined edges, the reinforcing ridge of the present invention includes a short extension connected to the first unjoined edge. A long extension is connected to the second unjoined edge. A connection locking slot is formed in the long extension and conformed to just receive and retain the short section when the unjoined edges are brought together. In a further embodiment of the invention, the short and long extensions have front and back faces. The long extension front face, in this embodiment, is conformed to cover the short extension front face and partially cover the short extension back face.

In a further embodiment, the rigid material is formed into a rectangle with the reinforcing ridge in one side and at least one reinforcing rib in a side facing the reinforcing ridge. In a still further embodiment, the invention includes at least one reinforcing rib in a side facing the reinforcing ridge and at least one strength indent in a side adjacent to the reinforcing ridge. Other preferred embodiments include two reinforcing ribs; two strength indents; two pairs of strength indents; and combinations thereof.

A method of joining two unjoined edges in a length of rigid material is also disclosed. In a preferred embodiment, the method includes forming a short extension in the first unjoined edge and a long extension in the second unjoined edge. Thereafter the first and second unjoined edges are brought together and the long extension is bent over the short extension forming a connection locking slot so that the first and second unjoined edges are joined together and form a reinforcing ridge. Other embodiments of the method of the invention include forming at least one reinforcing rib in a side facing the reinforcing ridge. Additional preferred embodiments include providing at least one strength indent in a side adjacent to the reinforcing ridge. Additional methods disclose preferred embodiments of various combinations of the reinforcing ridge and reinforcing ribs and strength indents.

BRIEF DESCRIPTION OF THE DRAWINGS

Other objects, features and advantages of the present invention will become more fully apparent from the following detailed description of the preferred embodiments, the appended claims and the accompanying drawings in which:

DETAILED DESCRIPTION OF THE PREFERRED EMBODIMENTS

Figure 1:
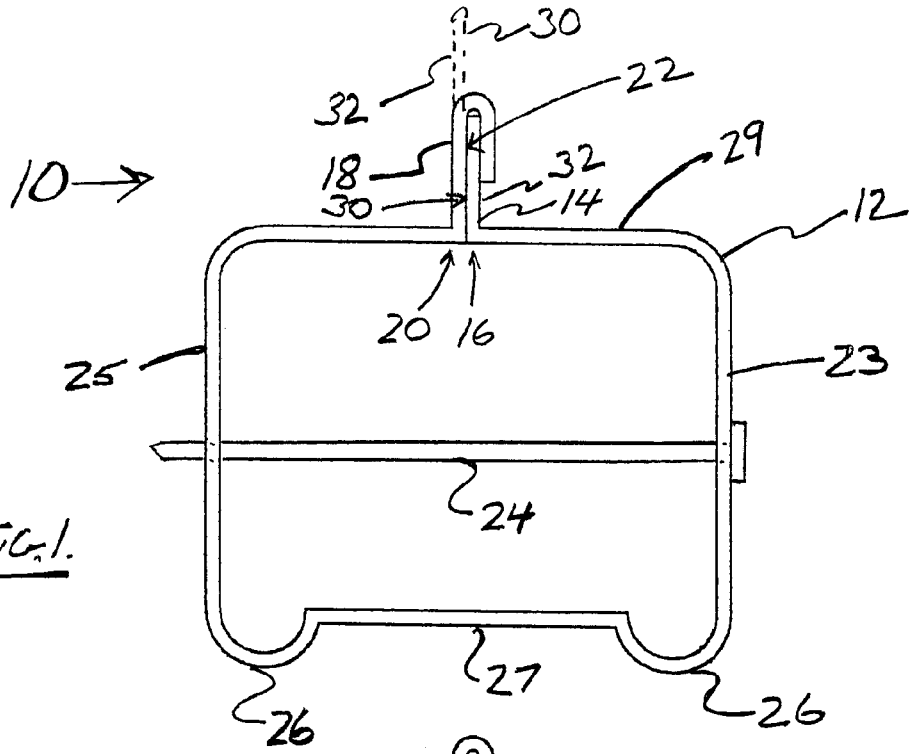
FIG. 1 is a side section view of a preferred embodiment of the reinforcing ridge of the present invention.
Figure 2:
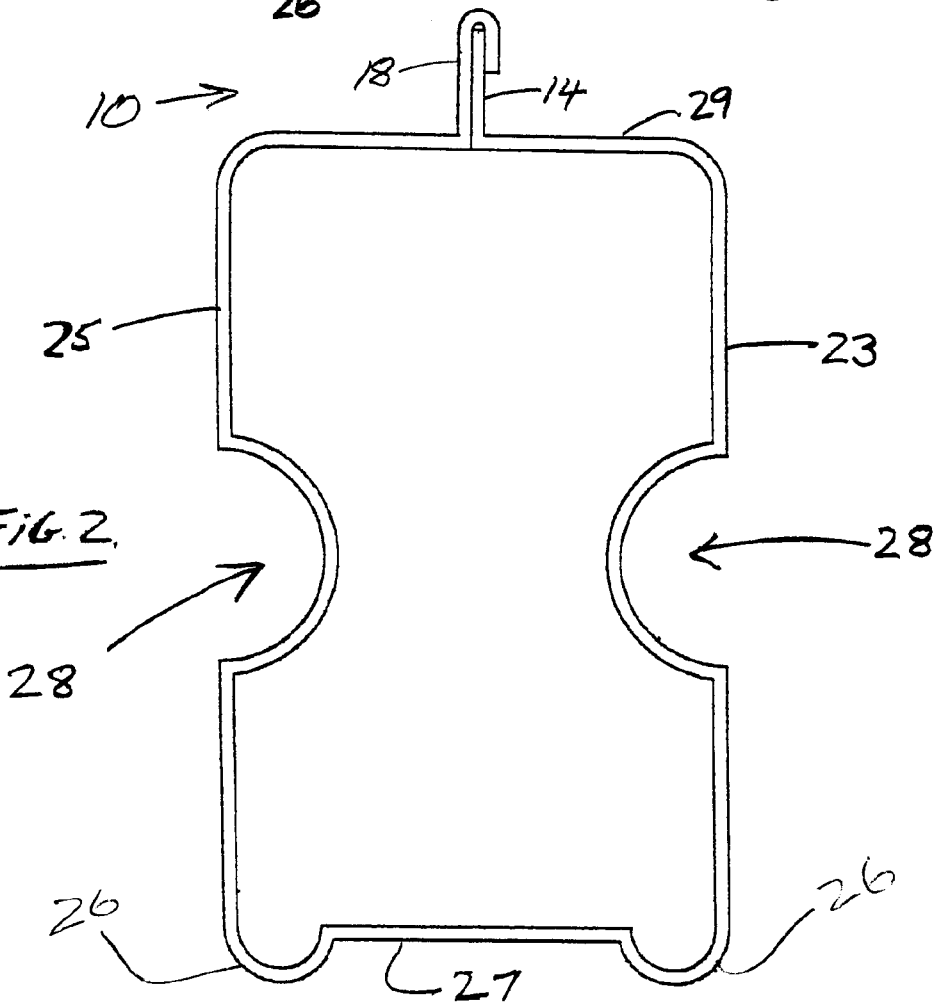
FIG. 2 is a side section view of a preferred embodiment with two reinforcing ribs and two strength indents.
Figure 3:
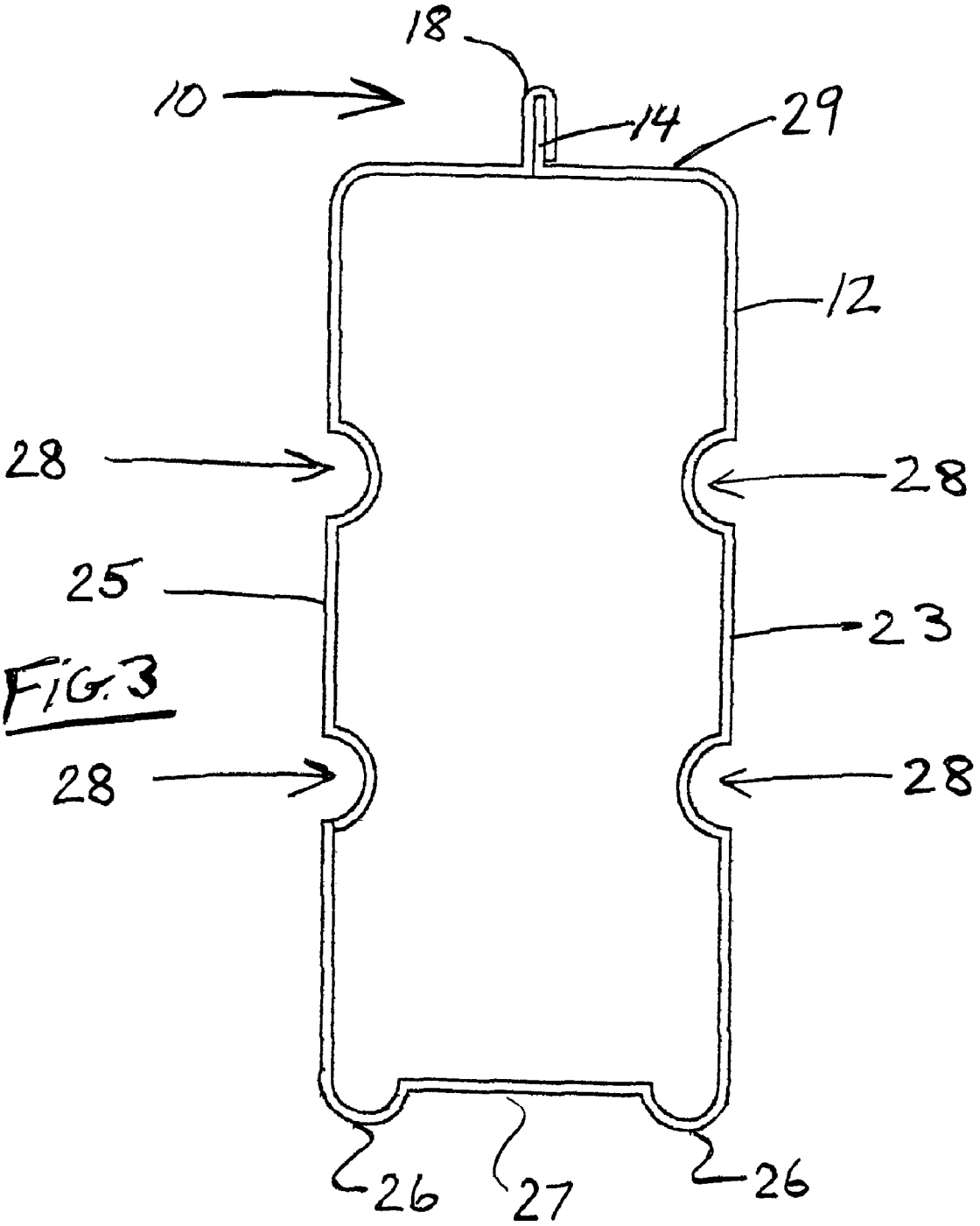
FIG. 3 is a side section view of a preferred embodiment of the present invention with two reinforcing ribs and two pairs of strength indents.

The preferred embodiments of the present invention are illustrated by way of example in FIGS. 1–3. With specific reference to FIG. 1, the reinforcing ridge 10 of the present invention includes a length of rigid material 12. Length of rigid material 12 has a short extension 14 connected to a first unjoined edge 16. Length of rigid material 12 further includes long extension 18 connected to second unjoined edge 20. As illustrated in FIG. 1, long extension 18 is first brought into contact with short extension 14 in an extended position as illustrated by the dotted broken lines. Thereafter, long extension 18, in a preferred embodiment, is bent over short extension 14 and forms a connection locking slot 22 into and within which the short extension 14 is retained. Connection locking slot 22 obviously may be made before joining edges 16 and 20. In such a case, connection locking slot 22 may be formed to just accept short extension 14 so that short extension 14 is forced to fit into, and is held by, locking slot 22. Obviously in either case locking slot 22 may be further compressed or crimped to ensure a tighter connection if desired.

Reinforcing ridge 10 simply and inexpensively joins unjoined edge 16 with unjoined edge 20 without the need of welding, screws, bolts or the like. An important resulting advantage from reinforcing ridge 10 is that, as illustrated in FIG. 1, an automatic joining device such as a pneumatic gun shooting nails 24, for example, can be utilized without collapsing rigid material 12. FIG. 1 shows nail 24 as having been shot through two sides, 23 and 25, of rigid material 12. Obviously, the usual intended purpose is to join rigid material 12, as illustrated in FIG. 1, with another section of rigid material 12, not shown. Assuming the second section of rigid material 12 also includes reinforcing ridge 10, the results are the same. That is, the sides, 23 and 25, of rigid material 12 are reinforced by reinforcing ridge 10 so as to resist collapse and enable use of an automatic joining device. Obviously the advantages of the invention are not limited to the use of a nail gun but also easily accommodate other automatic joining methods such as screws, for example.

FIG. 1 also illustrates another preferred embodiment of the invention. In this embodiment, at least one reinforcing rib 26 is formed in a side, 27, opposite the reinforcing ridge 10. FIG. 1 shows a pair of reinforcing ribs 26 formed in the corners of the side 27 opposite the reinforcing ridge 10. The applicant has found that reinforcing ribs 26 also enhance the ability of the invention to resist collapse and thereby further facilitate the use of automatic joining devices.

In the field of construction with the use of man-made materials, a common material is sheet metal. FIG. 1 shows a length of rigid material 12, such as sheet metal, formed into a rectangular shape with four sides, 23, 25, 27, and 29. Obviously, as further illustrated hereafter, any appropriate building shape may be adapted to the invention including but not limited to triangular and round shapes for example.

Referring now to FIG. 2, another preferred embodiment of the present invention is illustrated. In this embodiment, length of rigid material 12 is formed into an extended rectangular shape. The rectangular shape shown in FIG. 2 includes reinforcing ridge 10 and a pair of reinforcing ribs 26. Additionally, however, FIG. 2 includes at least one strength indent 28 in side 23 and/or side 25. Applicant has determined that the use of one or more strength indents 28 further prevents collapse of the rigid material when used with automatic joining devices and enables the material to resist compression and twisting moments.

Referring now to FIG. 3, another preferred embodiment of the present invention is illustrated. In this embodiment, the length of rigid material 12 is again formed into an extended rectangular shape. The rectangular shape shown in FIG. 3 includes reinforcing ridge 10, at least one reinforcing rib 26 and two pairs of strength indents 28. As with FIG. 2, FIG. 3 shows that strength indents 28 are located in a side, 23 or 25, adjacent to reinforcing ridge 10. That is, strength indents 28 are located between reinforcing ridge 10 and reinforcing ribs 26 on the joining sides of the rectangle.

A major problem with prior art metal construction forms, again, is that in either the open unjoined condition or the welded condition, they are subject to collapse and more costly to produce. Applicant's metal forms are stronger and may be joined together by automatic devices, such as pneumatic guns so that 20 to 30 percent less metal is used in building a structure. Further, the combination of at least one reinforcing rib 26 and/or at least one strength indent 28 in combination with the reinforcing ridge 10 of the present invention results in a significantly stronger metal form. This is true no matter what gauge material is used, i.e. 16, 18, and 20 gauge or the like. In the construction industry for example, the construction of a truss includes tension web and compression web members. Applicant's invention results in a rigid web member which is much better able to resist compression. Therefore, Applicant's invention results in a reduction of the number of compression web members required in the construction of a truss.

Referring again to FIG. 1, the structure of the invention is reviewed with some additional detail. It should be appreciated that short extension 14 and long extension 18 have a front face 30 and a back face 32. When first unjoined edge 18 is brought next to second unjoined edge 20 the front face 30 of long extension 18 generally covers the front face 30 of short section 14. As shown in FIG. 1, at this point long extension 18 is parallel to short section 30 as shown by the dotted lines. At some point, either before or after being brought next to each other, long extension 18 is bent over forming a connection locking slot 22 that covers some portion of the back face 32 of short extension 14. In a preferred embodiment, the front face 30 of long extension 18 covers approximately one-half of the back face 32 of short extension 14 when the two unjoined edges are brought together and short extension 14 is captured within connection locking slot 22.

The method of forming reinforcing ridge 10 in a preferred embodiment requires the positioning of first unjoined edge 16 adjacent to second unjoined edge 20 so that the front face 30 of long extension 18 meets with the front face 30 of short extension 14. In regard to forming, Applicant's invention enables rolled/machine forming of reinforcing ridge 10, so that no additional handling, crimping or the like is required to securely join the unjoined edges. At that point, long extension 18 is bent over short extension 14, forming connection locking slot 22, and resulting in reinforcing ridge 10. Obviously, connection locking slot 22 may be formed before bringing long extension 18 next to short extension 14. Other preferred methods include forming at least one reinforcing rib 26 in side 27 opposite the reinforcing ridge 10. Still further preferred methods include forming strength indents 28 in the sides, 23 and 25, adjacent to reinforcing ridge 10.

As is obvious to those of ordinary skill in the art, once reinforcing ridge 10 is created, multiple sections of rigid material 12 may be joined together using automatic joining devices as previously discussed. This alone greatly reduces the cost of structures made of man-made materials. The addition of reinforcing ribs 26 and/or strength indents 28 further increase the usability and versatility and affordability of structures made from man-made materials.

While the present invention has been disclosed in connection with the preferred embodiments thereof, it should be understood that there may be other embodiments which fall within the spirit and scope of the invention as defined by the following claims.

What is claimed is:

1. In a length of rigid material with first and second unjoined edges, a reinforcing ridge comprising:

(a) a short extension connected to said first unjoined edge;

(b) a long extension connected to said second unjoined edge;

(c) a connection locking slot in said long extension conformed to just receive and retain said short section when said unjoined edges are brought together; and (d) wherein said rigid material forms a rectangle with said reinforcing ridge in one side and at least one reinforcing rib in a side facing said reinforcing ridge.

2. The invention of claim 1 further comprising:

(a) front and back faces on said short and long extensions; and (b) said long extension front face conformed to generally cover said short extension front face and partially cover said short extension back face.

3. The invention of claim 2 wherein said long extension is approximately twice as long as said short section and said long extension generally covers all of the front face of said short extension and approximately one-half of the back face of said short extension.

4. The invention of claim 1 further comprising two reinforcing ribs.

5. The invention of claim 1 wherein said rigid material forms a rectangle with said reinforcing ridge in one side and at least one reinforcing rib in a side facing said reinforcing ridge and at least one strength indent in a side adjacent to said reinforcing ridge.

6. The invention of claim 5 further comprising two strength indents, one strength indent in each side adjacent to said reinforcing ridge.

7. The invention of claim 5 further comprising a pair of strength indents, two strength indents in each side adjacent to said reinforcing ridge.

8. The invention of claim 5 further comprising a pair of reinforcing ribs in a side facing said reinforcing ridge.

9. The invention of claim 5 further comprising a pair of reinforcing ribs in a side facing said reinforcing ridge and a pair of strength indents, one strength indent in each side adjacent to said reinforcing ridge.

10. The invention of claim 5 further comprising a pair of reinforcing ribs in a side facing said reinforcing ridge and two pairs of strength indents, one pair of strength indents in each side adjacent to said reinforcing ridge.

11. The invention of claim 1 wherein said rigid material is sheet metal.

12. In a length of rigid material with first and second unjoined edges, a method of joining said edges and forming a reinforcing ridge comprising the steps of:

(a) forming a short extension in said first unjoined edge;

(b) forming a long extension in said second unjoined edge;

(c) bringing said first and second unjoined edges together and bending said long extension over said short extension and forming a connection locking slot so that said first and second unjoined edges are joined together and form said reinforcing ridge;

(d) forming said rigid material into a rectangular shape with said reinforcing ridge in one side; and (e) forming at least one reinforcing rib in a side facing said reinforcing ridge.

13. The method of claim 12 further comprising the steps of forming said short and long extensions with front and back faces so that when said unjoined edges are joined together, and the front face of said long extension generally covers the front face of said short extension and partially covers the back face of said short extension.

14. The method of claim 13 further comprising the step of forming said long extension so that it is approximately twice as long as said short extension and generally covers the front face of said short extension and approximately one-half of the back face of said short extension when said unjoined edges are brought together.

15. The method of claim 12 further comprising the step of forming two reinforcing ribs in the side facing said reinforcing ridge.

16. The method of claim 12 further comprising the step of forming at least one strength indent in a side adjacent to said reinforcing ridge.

17. The method of claim 16 further comprising the step of forming a pair of strength indents, one in each side adjacent to said reinforcing ridge.

18. The method of claim 16 further comprising the step of forming two pairs of strength indents, one pair in each side adjacent to said reinforcing ridge.

* * * * *